US011524854B2

(12) United States Patent
Imaizumi

(10) Patent No.: US 11,524,854 B2
(45) Date of Patent: Dec. 13, 2022

(54) BELT CONVEYANCE DEVICE AND IMAGE FORMING APPARATUS

(71) Applicant: CANON KABUSHIKI KAISHA, Tokyo (JP)

(72) Inventor: Chikara Imaizumi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/994,131

(22) Filed: Aug. 14, 2020

(65) Prior Publication Data

US 2021/0061599 A1 Mar. 4, 2021

(30) Foreign Application Priority Data

Aug. 30, 2019 (JP) ..... JP2019-158449
Jun. 17, 2020 (JP) ..... JP2020-104701

(51) Int. Cl.
*B65H 5/02* (2006.01)
*G03G 15/00* (2006.01)
*B65H 29/16* (2006.01)

(52) U.S. Cl.
CPC ..... *B65H 5/021* (2013.01); *B65H 29/16* (2013.01); *G03G 15/6502* (2013.01); *B65H 2404/251* (2013.01); *B65H 2404/255* (2013.01); *B65H 2801/06* (2013.01)

(58) Field of Classification Search
CPC .... B65H 5/021; B65H 29/16; B65H 2801/06; B65H 2404/255; B65H 2404/251; B65H 2402/52; B65H 2402/521; B65H 2402/522; G03G 15/1615; G03G 21/1647; G03G 21/168; G03G 2221/1654; G03G 2221/1642
See application file for complete search history.

(56) References Cited

U.S. PATENT DOCUMENTS 6,467,965 B1 * 10/2002 Wyer ..... G03G 15/0806 384/295

FOREIGN PATENT DOCUMENTS

| | | | |
|---|---|---|---|
| JP | 11-079459 A | | 3/1999 |
| JP | 2000039695 A | * | 2/2000 |
| JP | 2005-138986 A | | 6/2005 |
| JP | 2007298829 A | * | 11/2007 |
| JP | 2009-092859 A | | 4/2009 |
| JP | 2010-175689 A | | 8/2010 |

* cited by examiner

*Primary Examiner* — Luis A Gonzalez
(74) *Attorney, Agent, or Firm* — Canon U.S.A., Inc. I.P. Division

(57) ABSTRACT

A bearing which supports one end side of a driving roller includes a first restriction portion which is restricted from rotating and moving with respect to a first frame, and a bearing which supports the other end side of the driving roller includes a second restriction portion which is restricted from rotating and moving with respect to a second frame. As viewed from a direction perpendicular to a width direction of an intermediate transfer belt, a phase of shape of the first restriction portion in a state of being held by the first frame and a phase of shape of the second restriction portion in a state of being held by the second frame are equal to each other.

10 Claims, 12 Drawing Sheets

BELT CONVEYANCE DEVICE AND IMAGE FORMING APPARATUS

BACKGROUND

Field of the Disclosure

Aspects of the present disclosure generally relate to a belt conveyance device, which rotationally moves an endless belt while suspending the endless belt in a tensioned manner with a plurality of stretching members, and an image forming apparatus, such as a printer or a copying machine, using an electrophotographic method, which includes the belt conveyance device.

Description of the Related Art

Some conventional image forming apparatuses, such as printers or copying machines, using an electrophotographic method include a belt conveyance device which rotationally moves an endless belt while suspending the endless belt in a tensioned manner with a plurality of stretching members such as stretching rollers. In such a belt conveyance device, there is a known issue in which, when the belt is rotationally moved, the belt may draw to a one-end side thereof in a belt width direction (the axial direction of a stretching roller), which is a direction perpendicular to a belt movement direction.

To address this issue, for example, Japanese Patent Application Laid-Open No. 2010-175689 discusses a configuration in which ribs are provided along both end portions of the reverse surface of a belt and, at both end sides of a stretching roller, flanges are provided on the inner side of the ribs provided on the reverse surface of the belt with respect to the width direction of the belt. In the configuration discussed in Japanese Patent Application Laid-Open No. 2010-175689, if the belt moves in the width direction, the rib provided on the reverse surface of the belt comes into abutment contact with the flange provided at the stretching roller, so that the lateral shift of the belt is restricted.

Moreover, Japanese Patent Application Laid-Open No. 11-079459 discusses a configuration in which a stretching roller is able to be tilted with respect to the width direction of a belt. In the configuration discussed in Japanese Patent Application Laid-Open No. 11-079459, when a force by which the belt is caused to draw to one side with respect to the width direction of the belt (hereinafter referred to as a "lateral-shift force") occurs, the stretching roller is tilted by using a difference between tensile forces which the belt exerts on the stretching roller, so that the lateral shift of the belt can be restricted.

In the configuration discussed in Japanese Patent Application Laid-Open No. 2010-175689, in which the rib coming into contact with the flange with respect to the width direction of the belt restricts the lateral shift of the belt, if the belt continues being rotationally driven for a long time in the state in which the lateral-shift force is large, peel-off of the rib from the belt or deformation of the rib may occur. To prevent such cases, it is necessary to enhance the strength of adhesion between the belt and the rib or to make the rib itself from a high-strength material, which may lead to a cost increase caused by an adhesion process or a cost increase of the rib itself.

Moreover, even in the configuration discussed in Japanese Patent Application Laid-Open No. 11-079459, if the lateral-shift force of the belt is too large, it is necessary to widen a correction range for correcting lateral shift of the belt by tilting the stretching roller. As a result, a space required for a mechanism which restricts the lateral shift of the belt becomes large, so that it may become difficult to reduce the sizes of a belt conveyance device and an image forming apparatus.

SUMMARY

Aspects of the present disclosure generally provide a belt conveyance device and an image forming apparatus each of which is capable of preventing or reducing a lateral-shift force of a belt, which is rotationally driven while being suspended in a tensioned manner by a plurality of stretching rollers, from becoming large.

According to an aspect of the present disclosure, a belt conveyance device includes a belt of an endless shape configured to rotationally move, a first stretching roller and a second stretching roller configured to suspend the belt in a tensioned manner, a first bearing member configured to support a shaft end portion on a first end side of the first stretching roller with respect to a width direction perpendicular to a movement direction of the belt, a second bearing member configured to support a shaft end portion on a second end side of the first stretching roller with respect to the width direction, a first frame portion including a holding portion configured to hold the first bearing member, a second frame portion including a holding portion configured to hold the second bearing member, the belt being arranged between the first frame portion and the second frame portion with respect to the width direction, wherein the first bearing member includes a first restriction portion which is restricted from rotating relative to the first frame portion and the second bearing member includes a second restriction portion which is restricted from rotating relative to the second frame portion, and wherein, as viewed from a direction perpendicular to the width direction, a phase of shape of the first restriction portion in a state of being held by the first frame portion and a phase of shape of the second restriction portion in a state of being held by the second frame portion are equal to each other.

Further features of the present disclosure will become apparent from the following description of exemplary embodiments with reference to the attached drawings.

DESCRIPTION OF THE EMBODIMENTS

Various exemplary embodiments, features, and aspects of the disclosure will be described in detail below with reference to the drawings. However, for example, the dimensions, materials, shapes, and relative locations of constituent components described in the following exemplary embodiments are those which are to be altered or modified as appropriate according to configurations of devices or apparatuses to which the aspects of the disclosure are applied and various conditions. Accordingly, unless specifically described otherwise, the following exemplary embodiments should not be construed to limit the scope of the disclosure.

[Configuration of Image Forming Apparatus]

Figure 1:
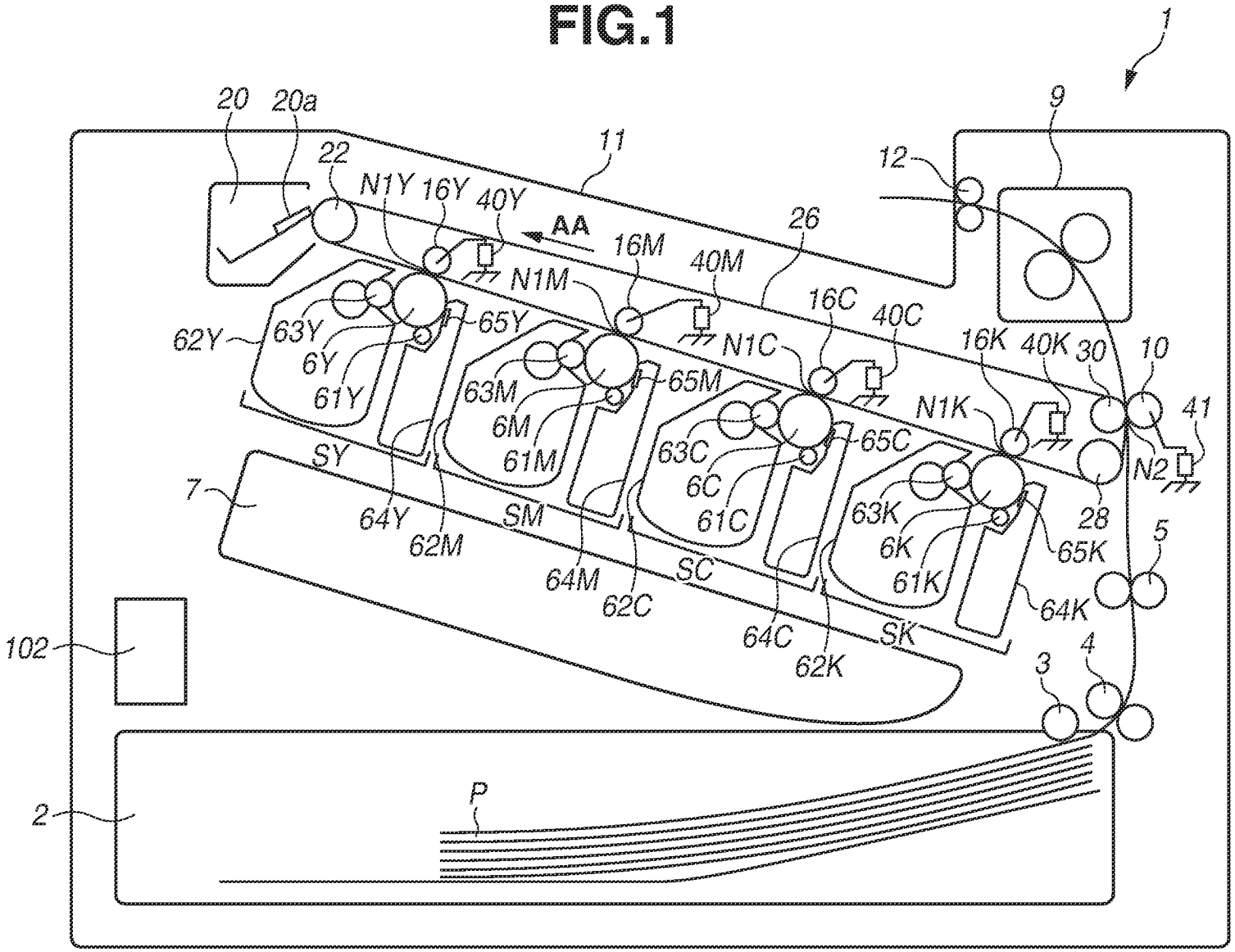
FIG. 1 is an outline sectional view illustrating a configuration of an image forming apparatus in a first exemplary embodiment.

FIG. 1 is an outline configuration diagram of an image forming apparatus 1 in a first exemplary embodiment. As illustrated in FIG. 1, the image forming apparatus 1 in the first exemplary embodiment is a color image forming apparatus of the intermediate transfer type using an electrophotographic method, and includes first, second, third, and fourth image forming units SY, SM, SC, and SK as a plurality of image forming units. The first, second, third, and fourth image forming units SY, SM, SC, and SK are configured to form images of the respective colors, i.e., yellow (Y), magenta (M), cyan (C), and black (Bk). These four image forming units SY, SM, SC, and SK are arranged in a row at fixed intervals, and, in the first exemplary embodiment, the image forming units SY, SM, SC, and SK are arranged below an intermediate transfer belt 26 with respect to the direction of gravitational force. Furthermore, in the first exemplary embodiment, the respective configurations of the first to fourth image forming units SY, SM, SC, and SK are substantially the same except that colors of toners to be respectively used differ from each other. Accordingly, unless distinction is specifically needed, suffixes "Y", "M", "C", and "K", which are assigned to the respective reference numerals in the drawings to indicate for which color the respective elements are provided, are omitted in the following description, and these elements are collectively described.

Each image forming unit S includes a drum-type electrophotographic photosensitive member 6 (hereinafter referred to as a "photosensitive drum 6") 2, which is able to rotate and which serves as an image bearing member on which to form a toner image. A charging roller 61, which serves as a charging member configured to electrically charge the photosensitive drum 6, a developing unit 62, and a cleaning unit 64 are arranged around the photosensitive drum 6. Moreover, an exposure portion, which is irradiated with laser light emitted from an exposure unit 7 (laser scanner), is located at a downstream side of the charging roller 61 and at an upstream side of the developing unit 62 with respect to the rotational direction of the photosensitive drum 6.

The developing unit 62 includes a development roller 63, which serves as a developing member, and toner, which serves as a developer. The development roller 63 is able to rotate upon receiving a driving force from a drive source (not illustrated). The cleaning unit 64 includes a cleaning blade 65, which serves as a cleaning member being in abutment contact with the photosensitive drum 6, and stores toner recovered by the cleaning blade 65.

Next, the overall configuration of the image forming apparatus 1 is described. As illustrated in FIG. 1, an intermediate transfer belt 26, which is an endless intermediate transfer member, is located opposite to the photosensitive drum 6 of the image forming unit S. The intermediate transfer belt 26 is suspended in a tensioned manner by a plurality of stretching members, and, more specifically, the intermediate transfer belt 26 is suspended in a tensioned manner by three stretching rollers, i.e., a driving roller 30, a driven roller 28, and a tension roller 22. Moreover, the intermediate transfer belt 26 is able to be moved in the direction of arrow AA illustrated in FIG. 1 by rotation of the driving roller 30, which rotates upon receiving a driving force from a drive source (not illustrated).

A primary transfer roller 16, which serves as a primary transfer member (transfer member), is located at a position opposite to the photosensitive drum 6 via the intermediate transfer belt 26. The primary transfer roller 16 is urged at a predetermined pressure against the photosensitive drum 6 via the intermediate transfer belt 26, and thus forms a primary transfer portion (a primary transfer nip) N1 at which the intermediate transfer belt 26 and the photosensitive drum 6 are in contact with each other. Moreover, a primary transfer power source 40 is connected to the primary transfer roller 16, and the primary transfer power source 40 is able to apply a voltage of the positive polarity or negative polarity to the primary transfer roller 16.

On the outer circumferential surface side of the intermediate transfer belt 26, a secondary transfer roller 10, which serves as a secondary transfer member, is located at a position opposite to the driving roller 30. The secondary transfer roller 10 is urged at a predetermined pressure against the driving roller 30 via the intermediate transfer belt 26, and thus forms a secondary transfer portion (a secondary transfer nip) N2 at which the intermediate transfer belt 26 and the secondary transfer roller 10 are in contact with each other. A secondary transfer power source 41 is connected to the secondary transfer roller 10, and the secondary transfer power source 41 is able to apply a voltage of the positive polarity or negative polarity to the secondary transfer roller 10.

A cleaning unit 20, which recovers toner remaining on the intermediate transfer belt 26 after secondary transfer (hereinafter referred to as "residual toner"), is provided at the upstream side of each photosensitive drum 6 and at the downstream side of the secondary transfer portion N2 with regard to the movement direction of the intermediate transfer belt 26. The cleaning unit 20 includes a cleaning blade 20*a*, which is in abutment contact with the intermediate transfer belt 26.

A paper feed cassette 2, which stores transfer materials P, a feed roller 3, which feeds a transfer material P, and a conveyance roller 4 and a conveyance roller 5, each of which conveys a transfer material P to the secondary transfer portion N2, are provided at the upstream side of the secondary transfer portion N2 with regard to the conveyance direction of the transfer material P. Moreover, a fixing unit 9, which includes a heat source, a paper discharge roller 12, which is used to discharge a transfer material P from the image forming apparatus 1, and a paper discharge tray 15, which is used to stack the discharged transfer materials P, are provided at the downstream side of the secondary transfer portion N2 with regard to the conveyance direction of the transfer material P.

[Image Forming Operation]

When an operation start signal and an image signal output from a host device (not illustrated) are transmitted to a controller 102, which serves as a control unit, the controller 102 controls various units to start an image forming operation in the image forming apparatus 1. When the image forming operation is started, the photosensitive drums 6, the intermediate transfer belt 26, and the development rollers 63 start to rotate at respective predetermined speeds upon receiving driving forces from respective drive sources (not illustrated). The surface of the photosensitive drum 6 rotating is electrically charged by the charging roller 61 in an approximately uniform manner with a predetermined polarity (in the first exemplary embodiment, a negative polarity). At this time, the charging roller 61 has a predetermined charging voltage applied from a charging power source (not illustrated). After that, the photosensitive drum 6 is exposed by the exposure unit 7 based on image information corresponding to each image forming unit S, so that an electrostatic latent image equivalent to the image information is formed on the surface of the photosensitive drum 6.

The development roller 63 bears toner electrically charged with the normal charging polarity of toner (in the first exemplary embodiment, a negative polarity), and has a predetermined development voltage applied from a development power source (not illustrated). This causes a latent image formed on the photosensitive drum 6 to be made visible with toner of the negative polarity at a facing portion between the photosensitive drum 6 and the development roller 63 (a development portion), so that a toner image is formed on the photosensitive drum 6.

Next, the toner image formed on the photosensitive drum 6 is transferred (primarily transferred), at the primary transfer portion N1, to the intermediate transfer belt 26, which is being rotationally driven, by a current flowing from the primary transfer roller 16 to the photosensitive drum 6 (hereinafter referred to as a "primary transfer current"). At this time, the primary transfer roller 16 has a voltage of a polarity (in the first exemplary embodiment, a positive polarity) opposite to the normal charging polarity of toner applied from the primary transfer power source 40. In other words, in the configuration of the first exemplary embodiment, a toner image is primarily transferred from the photosensitive drum 6 to the intermediate transfer belt 26 by constant current control which controls the output of the primary transfer power source 40 in such a manner that a predetermined primary transfer current flows from the primary transfer roller 16 toward the photosensitive drum 6.

At the time of forming a full-color image, electrostatic latent images are formed on the respective photosensitive drums 6 in the respective image forming units S, and the thus-formed electrostatic latent images are then developed into toner images of the respective colors. Then, the toner images of the respective colors formed on the respective photosensitive drums 6 in the respective image forming units S are transferred in such a way as to be superimposed one after another to the intermediate transfer belt 26 in the respective primary transfer portions N1Y, N1M, N1C, and N1K, so that a four-color toner image is formed on the intermediate transfer belt 26.

Moreover, a transfer material P, which is stacked in the paper feed cassette 2 serving as a container portion, is fed to the conveyance roller 4 by the feed roller 3, and is then conveyed to the secondary transfer portion N2 by the conveyance roller 4 and the conveyance roller 5. Then, a four-color multiple toner image borne on the intermediate transfer belt 26 is transferred (secondarily transferred), at the secondary transfer portion N2, to the transfer material P, which is being conveyed, by a current flowing from the secondary transfer roller 10 to the intermediate transfer belt 26 (hereinafter referred to as a "secondary transfer current"). At this time, the secondary transfer roller 10 has a secondary transfer voltage of a polarity (in the first exemplary embodiment, a positive polarity) opposite to the normal charging polarity of toner applied from the secondary transfer power source 41. In other words, in the configuration of the first exemplary embodiment, a toner image is secondarily transferred from the intermediate transfer belt 26 to the transfer material P by constant current control which controls the output of the secondary transfer power source 41 in such a manner that a predetermined secondary transfer current flows from the secondary transfer roller 10 toward the intermediate transfer belt 26.

After that, the transfer material P with the toner image transferred thereto is conveyed to the fixing unit 9, in which the toner image is fixed to the surface of the transfer material P, and the transfer material P is then discharged to outside the apparatus body of the image forming apparatus 1 and is stacked on the paper discharge tray 15.

Furthermore, toner remaining on the photosensitive drum 6 after primary transfer is removed from the surface of the photosensitive drum 6 by the cleaning blade 65. Moreover, transfer residual toner remaining on the intermediate transfer belt 26 after passing through the secondary transfer portion N2 is removed from the surface of the intermediate transfer belt 26 by the cleaning blade 20*a*.

[Intermediate Transfer Unit]

Figure 2:
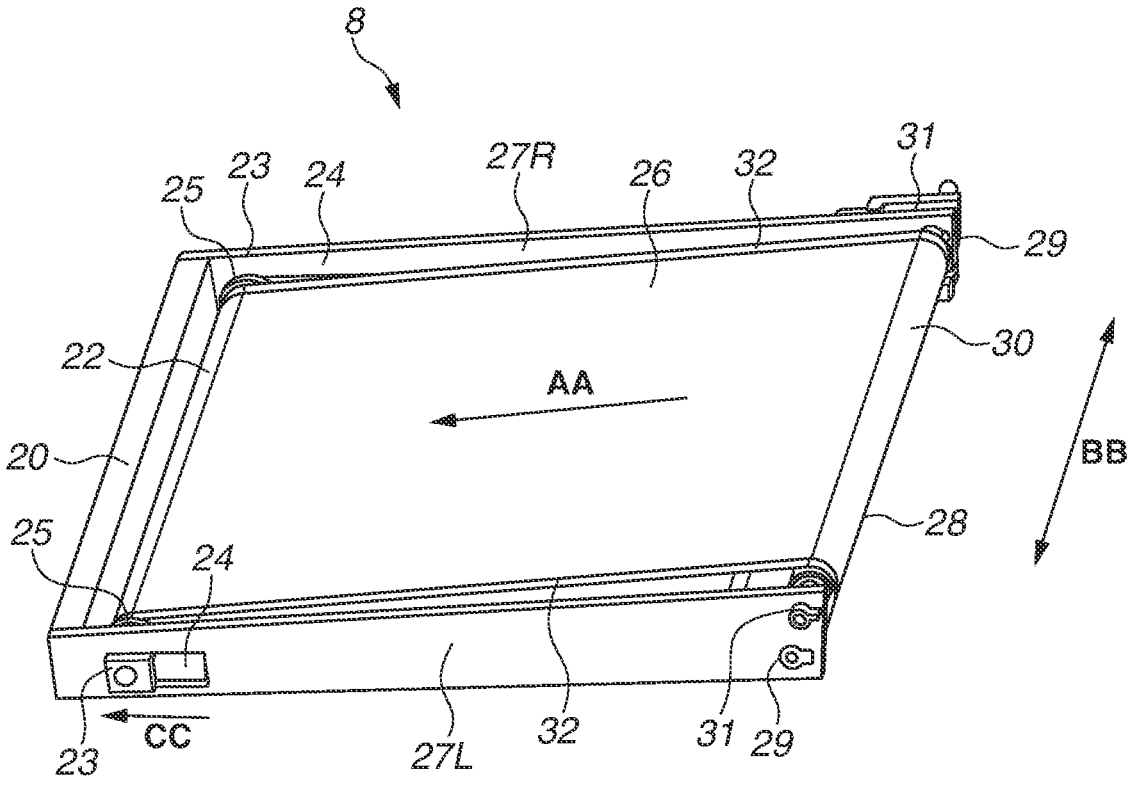
FIG. 2 is a schematic perspective view illustrating a configuration of a transfer unit in the first exemplary embodiment.

Next, the overall configuration of a belt stretching portion of a transfer unit 8 (a belt conveyance device) is described with reference to FIG. 2. FIG. 2 is a schematic perspective view illustrating a configuration of the transfer unit 8 in the first exemplary embodiment.

As illustrated in FIG. 2, the transfer unit 8 includes the intermediate transfer belt 26, and the driving roller 30, the driven roller 28, and the tension roller 22, which serve as a plurality of stretching rollers (stretching members) that suspends the intermediate transfer belt 26 in a tensioned manner. Moreover, the transfer unit 8 further includes a frame 27L (a first frame portion) and a frame 27R (a second frame portion), which form a frame body of the transfer unit 8, a spring 24 (an urging member), which urges the tension roller 22, and the cleaning unit 20. Furthermore, in the first exemplary embodiment, the frame 27L and the frame 27R are configured as a continuously integrated frame.

The driving roller 30 is a rotary member which rotates upon receiving a driving force from a drive source (not illustrated), and the rotation of the driving roller 30 causes the intermediate transfer belt 26 to rotationally move in the direction of arrow AA illustrated in FIG. 2. The driven roller 28 is driven to rotate in conjunction with the rotation of the intermediate transfer belt 26. The driving roller 30 and the driven roller 28 are supported in a rotatable manner at shaft portions thereof on both end sides by bearings 31 and bearings 29, respectively, with regard to the direction of arrow BB illustrated in FIG. 2, which is a width direction perpendicular to the direction of arrow AA illustrated in FIG. 2, which is a movement direction of the intermediate transfer belt 26. Here, the shaft portions on both end sides of the driving roller 30 are able to rotate while frictionally sliding on the bearings 31. Moreover, the shaft portions on both end sides of the driven roller 28 are able to rotate while frictionally sliding on the bearings 29.

With regard to the width direction of the intermediate transfer belt 26, the frame 27L is provided on one end side (a first end side) of the plurality of stretching rollers, and the frame 27R is provided on the other end side (a second end side) of the plurality of stretching rollers. The frame 27L and the frame 27R hold the bearings 31 and the bearings 29, which support the driving roller 30 and the driven roller 28, respectively. Here, the driving roller 30 and the roller 28 are held at the frame 27L and the frame 27R by the bearings 31 and the bearings 29 in the state of being parallel to each other. Moreover, with regard to the width direction of the intermediate transfer belt 26, the intermediate transfer belt 26 is located between the frame 27L and the frame 27R.

The tension roller 22 is supported in a rotatable manner by bearings 23 at both end sides thereof with regard to the width direction of the intermediate transfer belt 26. Then, the bearings 23 are held in the state of being able to slide with respect to an elongated holding hole provided in each of the frame 27L and the frame 27R. The bearing 23 is urged by the spring 24 (an urging member) in the direction of arrow CC illustrated in FIG. 2, thus imparting a tensile force to the intermediate transfer belt 26. Moreover, as with the driven roller 28, the tension roller 22 is driven to rotate in conjunction with the movement of the intermediate transfer belt 26, which is driven to rotate by the driving roller 30.

A reinforcing tape 32 is attached to each of the both end sides of the intermediate transfer belt 26 with regard to the width direction along the movement direction of the intermediate transfer belt 26. The reinforcing tape 32 extends over the approximately entire circumferential direction of the intermediate transfer belt 26. Moreover, a restriction flange 25 (a restriction member), which restricts the intermediate transfer belt 26 from moving with respect to the width direction of the intermediate transfer belt 26, is provided at each of the both end sides of the tension roller 22 with regard to the width direction of the intermediate transfer belt 26. Providing the restriction flange 25 restricts the movement of the intermediate transfer belt 26 caused by, for example, misalignment of the mounting flatness of the transfer unit 8, a difference between right-hand and left-hand circumferential lengths in the direction of arrow BB illustrated in FIG. 2 of the intermediate transfer belt 26, or a bilateral difference in the direction of arrow BB illustrated in FIG. 2 of pressure of the spring 24.

[Configuration of Bearing]

Figure 3A:
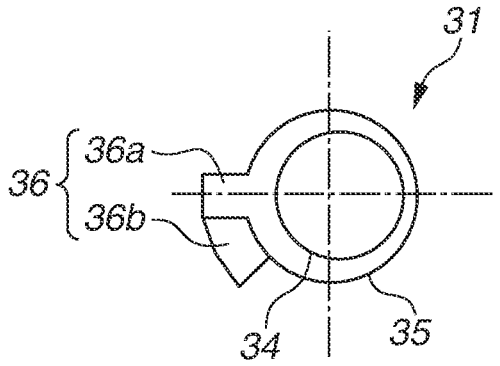
FIGS. 3A and 3B are schematic diagrams illustrating a configuration of a bearing in the first exemplary embodiment.
Figure 3B:
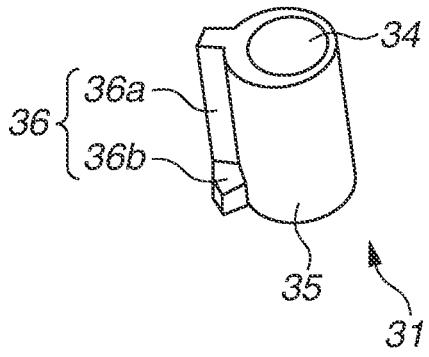

First, a method for manufacturing the bearing 31 for the driving roller 30 is described with reference to FIGS. 3A and 3B. FIG. 3A is a schematic top view of the bearing 31 obtained by injection molding. FIG. 3B is a schematic perspective view of the bearing 31 obtained by injection molding. The bearing 31 for the driving roller 30 is manufactured by injection molding, which injects a pellet of polyacetal resin into a mold.

The bearing 31 includes an inner circumferential surface 34, an outer circumferential surface 35, and a restriction portion 36, which determines a phase in rotational direction of the bearing 31 with respect to the frame 27L or the frame 27R and restricts a movement thereof in the axial direction of the driving roller 30. Here, the inner circumferential surface 34 is a surface which supports the shaft portion of the driving roller 30, and the outer circumferential surface 35 is a surface which is in contact with the frame 27L or the frame 27R when the bearing 31 is mounted to the frame 27L or the frame 27R.

The restriction portion 36 includes a rotation restriction portion 36*a*, which determines a phase in rotational direction of the bearing 31 with respect to the frame 27L or the frame 27R, and a position restriction portion 36*b*, which restricts a movement of the bearing 31 in the axial direction of the driving roller 30. The rotation restriction portion 36*a* has a shape which projects from the outer circumferential surface 35 toward the outside (the side opposite to the inner circumferential surface 34) in a radial direction of the bearing 31 and extends in the axial direction of the driving roller 30. Moreover, the position restriction portion 36*b* has a shape which projects from the outer circumferential surface 35 toward the outside (the side opposite to the inner circumferential surface 34) in a radial direction of the bearing 31 and extends along a circumferential direction of the outer circumferential surface 35 of the bearing 31, which is a direction intersecting with the axial direction of the driving roller 30.

With regard to the bearing 31 obtained in the above-described way, as illustrated in FIG. 3A, depending on the processing accuracy of a mold, an eccentricity in which the center of the inner circumferential surface 34 deviates from the center of the outer circumferential surface 35 may occur. Furthermore, in FIG. 3A, for ease of understanding the state of being eccentric, the amount of eccentricity is exaggeratingly illustrated. Such an eccentricity of the bearing may cause an inclination of the roller when the bearing is mounted as a bearing for the driving roller 30 or the driven roller 28 at both ends thereof and, thus, may cause a lateral-shift force of the intermediate transfer belt 26 to occur.

[Supporting Configuration for Tensile Suspension Roller]

Figure 4:
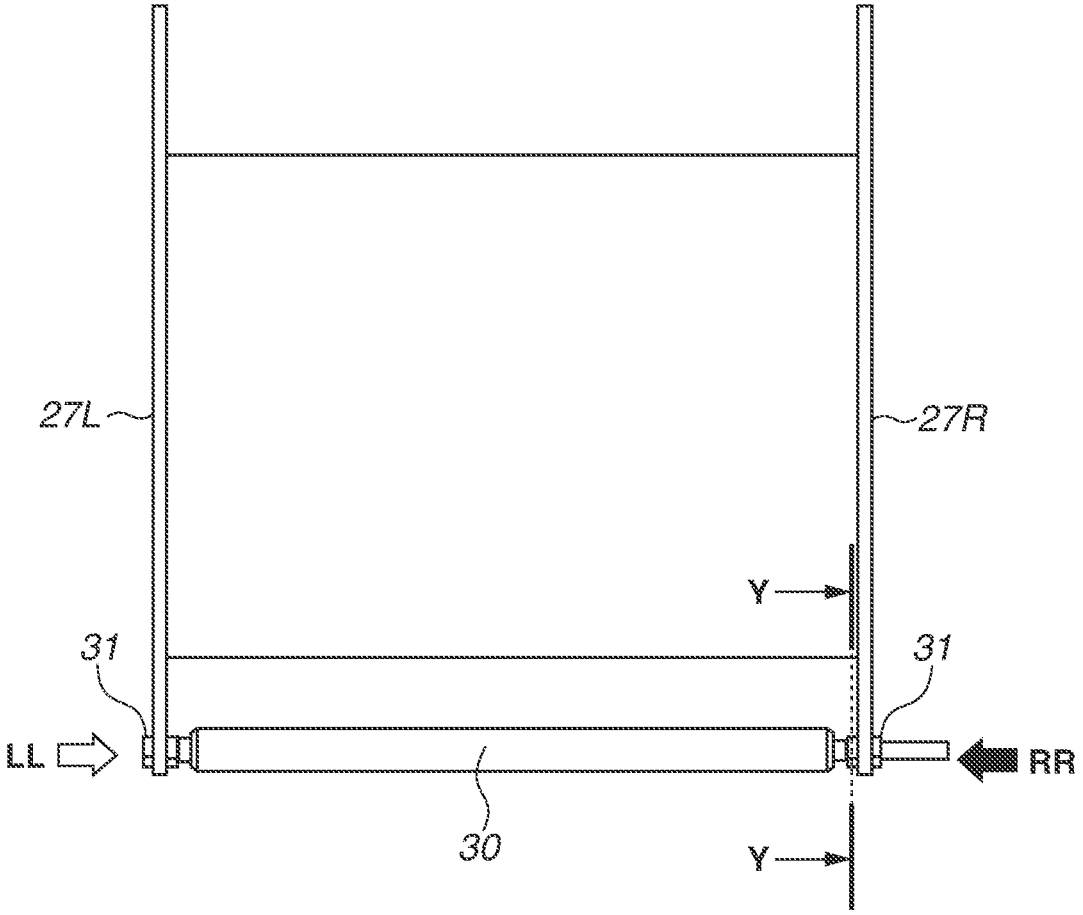
FIG.4 Prior Art
FIG. 4 is a schematic diagram illustrating a supporting configuration for a roller in a conventional example.
Figure 5:
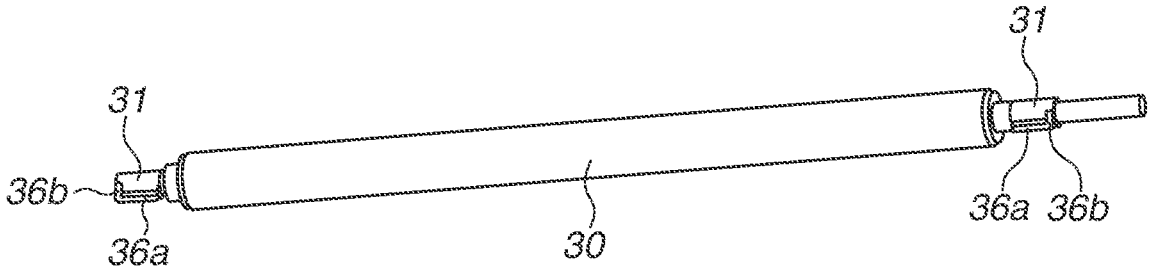
FIG.5 Prior Art
FIG. 5 is a schematic diagram used to explain the phase of a bearing in a state of supporting the roller in the conventional example.
Figure 6A:
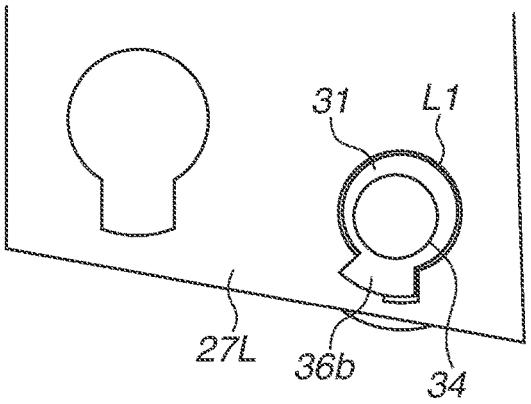
FIG.6A Prior Art
FIGS. 6A and 6B are schematic sectional views illustrating, as viewed from the axial direction of the roller, the bearing in a state of supporting the roller in the conventional example.
Figure 6B:
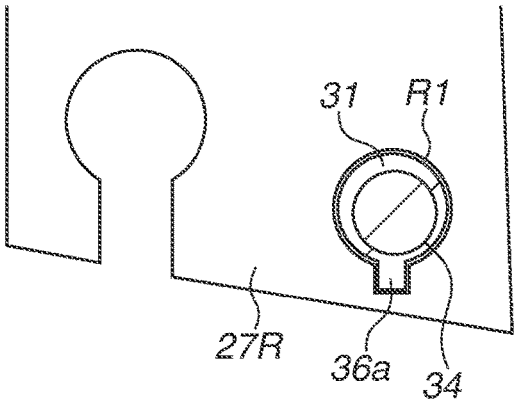
FIG.6B Prior Art

Next, a conventional example of a configuration for pivotally supporting the driving roller 30 is described with reference to FIG. 4, FIG. 5, and FIGS. 6A and 6B. FIG. 4 is a schematic diagram illustrating a conventional example of a configuration for pivotally supporting the driving roller 30. FIG. 5 is a schematic diagram in which the frame 27L and the frame 27R are omitted from illustration and which illustrates the driving roller 30 and a state in which the bearings 31 are mounted to the both end sides of the driving roller 30. FIG. 6A is a schematic side view illustrating the bearing 31 as viewed from the side of a surface of the frame 27L opposite to the surface thereof facing the intermediate transfer belt 26 in the axial direction of the driving roller 30. FIG. 6B is a schematic sectional view taken along line Y-Y illustrated in FIG. 4 as viewed from the side of the frame 27L.

As illustrated in FIG. 4 to FIGS. 6A and 6B, in the conventional example, first, the shaft portion of the driving roller 30 are inserted into a holding hole L1 and a holding hole R1 serving as holding portions provided in the frame 27L and the frame 27R, respectively. Then, with the shaft portion of the driving roller 30 inserted into the holding hole L1 and the holding hole R1, as illustrated in FIG. 4, a bearing 31 is mounted to the frame 27L and a shaft end portion on one end side of the shaft portion of the driving roller 30 from the direction of arrow LL illustrated in FIG. 4. Similarly, a bearing 31 is mounted to the frame 27R and a shaft end portion on the other end side of the shaft portion of the driving roller 30 from the direction of arrow RR illustrated in FIG. 4. With this mounting, the driving roller 30 is supported by the frames 27L and 27R via the respective left-hand and right-hand bearings 31.

As illustrated in FIG. 5, according to the mounting method and the pivotal supporting configuration for the driving roller 30 in the conventional example, the bearings 31 mounted to the respective left-hand and right-hand frames have a line-symmetric configuration with respect to the width direction of the intermediate transfer belt 26. In other words, in the configuration of the conventional example, as viewed from a direction perpendicular to the width direction of the intermediate transfer belt 26, the phase of shape of the restriction portion 36 in the state of being held by the frame 27L and the phase of shape of the restriction portion 36 in the state of being held by the frame 27R are different from each other. More specifically, with regard to the bearing 31 mounted to the frame 27L, the position restriction portion 36*b* is situated on the outside of the frame 27L, and, with regard to the bearing 31 mounted to the frame 27R, the position restriction portion 36*b* is situated on the outside of the frame 27R. Here, the insides of the frame 27L and the frame 27R represent sides between which the intermediate transfer belt 26 is provided, and the outsides of the frame 27L and the frame 27R represent the sides of surfaces opposite to the insides of the frame 27L and the frame 27R.

As illustrated in FIG. 6A, with regard to the bearing 31 mounted to the frame 27L, the inner circumferential surface 34 of the bearing 31 supporting the shaft end portion on one end side of the driving roller 30 deviates in the lower left direction. On the other hand, as illustrated in FIG. 6B, with regard to the bearing 31 mounted to the frame 27R, the inner circumferential surface 34 of the bearing 31 supporting the shaft end portion on the other end side of the driving roller 30 deviates in the lower right direction. In this case, since it results in that the driving roller 30 is supported in a slightly inclined state with respect to the frame 27L and the frame 27R, this may become a cause of occurrence of a lateral-shift force by which the intermediate transfer belt 26 draws to one side.

Figure 7:
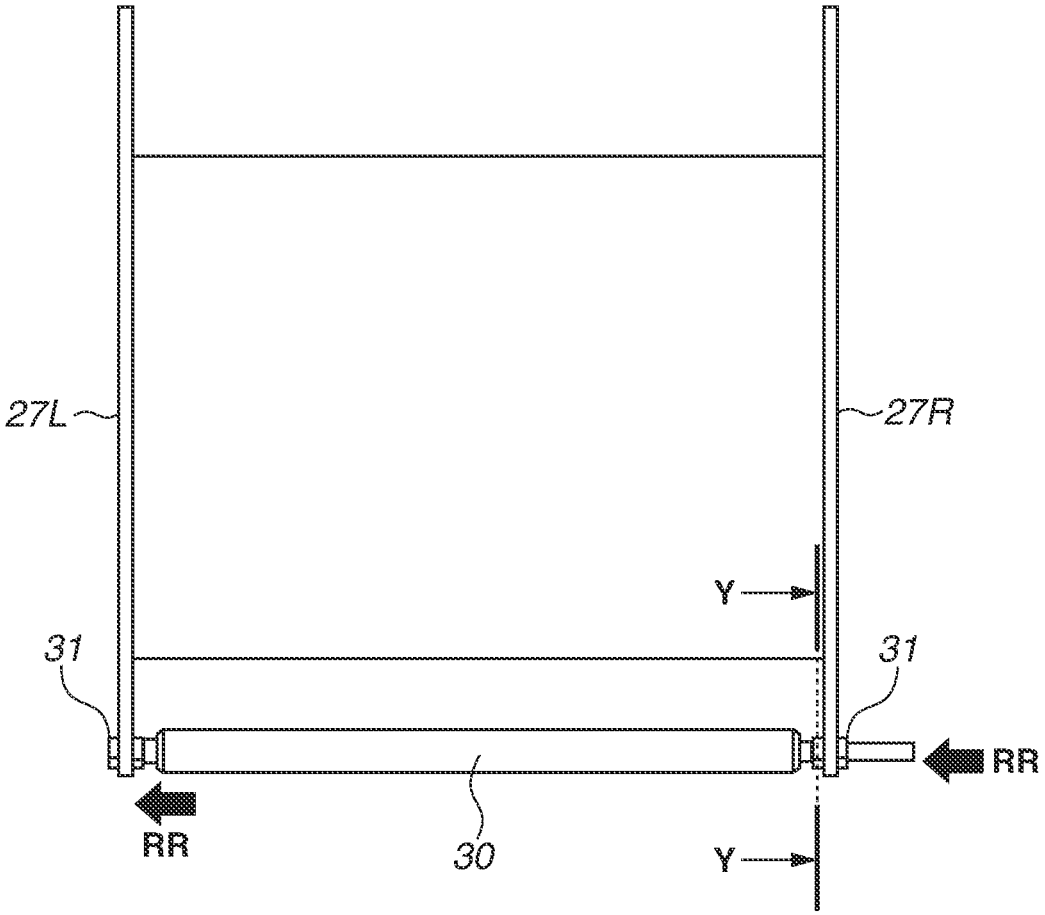
FIG. 7 is a schematic diagram illustrating a supporting structure for a roller in the first exemplary embodiment.
Figure 8:
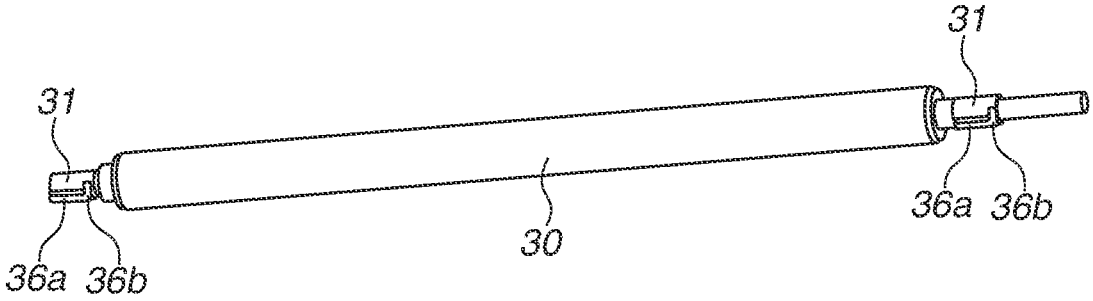
FIG. 8 is a schematic diagram used to explain the phase of a bearing in a state of supporting the roller in the first exemplary embodiment.
Figure 9A:
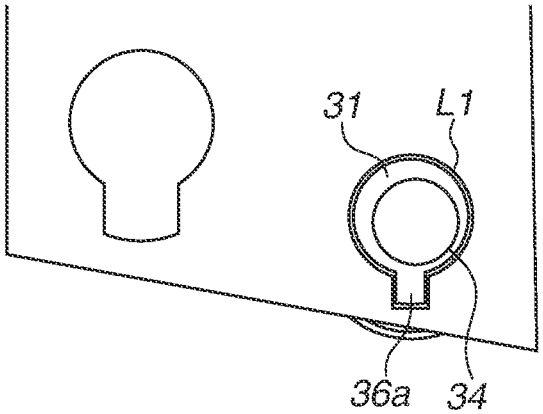
FIGS. 9A and 9B are schematic sectional views illustrating, as viewed from the axial direction of the roller, the bearing in a state of supporting the roller in the first exemplary embodiment.
Figure 9B:
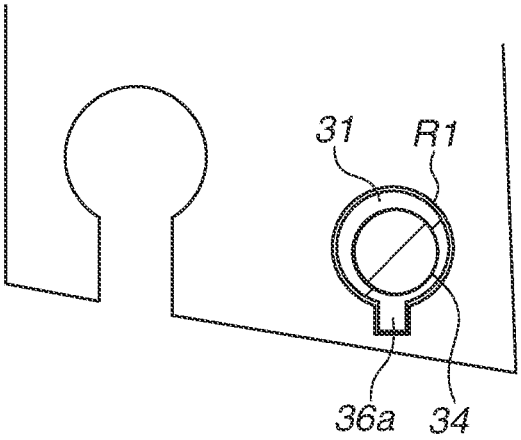

Next, a configuration for pivotally supporting the driving roller 30 in the first exemplary embodiment is described with reference to FIG. 7, FIG. 8, and FIGS. 9A and 9B. FIG. 7 is a schematic diagram illustrating a configuration for pivotally supporting the driving roller 30 in the first exemplary embodiment. FIG. 8 is a schematic diagram in which the frame 27L and the frame 27R are omitted from illustration and which illustrates the driving roller 30 and a state in which the bearings 31 are mounted to the both end sides of the driving roller 30. FIG. 9A is a schematic side view illustrating the bearing 31 as viewed from the side of a surface of the frame 27L opposite to the surface thereof facing the intermediate transfer belt 26 in the axial direction of the driving roller 30 in the first exemplary embodiment. FIG. 9B is a schematic sectional view taken along line Y-Y illustrated in FIG. 7 as viewed from the side of the frame 27L in the first exemplary embodiment.

As illustrated in FIG. 7 to FIGS. 9A and 9B, in the first exemplary embodiment, first, before the driving roller 30 is inserted into a holding hole L1 and a holding hole R1 serving as holding portions provided in the frame 27L and the frame 27R, respectively, a bearing 31 is attached to one end side of the driving roller 30. After that, after the shaft portion on the other end side of the driving roller 30 with the bearing 31 attached to one end side thereof is inserted into the holding portion of the frame 27R, one end side of the driving roller 30 with the bearing 31 attached thereto is mounted to the holding hole L1 from the direction of arrow RR (a first direction) illustrated in FIG. 7. Then, finally, with the shaft portion on the other end side of the driving roller 30 inserted into the holding hole R1, a bearing 31 is mounted to the holding hole R1 and the other end side of the shaft portion of the driving roller 30 from the direction of arrow RR illustrated in FIG. 7. In the first exemplary embodiment, performing mounting in such a process causes the driving roller 30 to be supported by the frame 27L and the frame 27R via the bearings 31 mounted at the respective left-hand and right-hand sides.

As illustrated in FIG. 8, according to the mounting method and the pivotal supporting configuration for the driving roller 30 in the first exemplary embodiment, the bearings 31 on one end side and the other end side of the shaft portion of the driving roller 30 do not have a line-symmetric configuration but have a configuration in which the same shapes are arranged side by side, with respect to the width direction of the intermediate transfer belt 26. In other words, in the configuration of the first exemplary embodiment, as viewed from a direction perpendicular to the width direction of the intermediate transfer belt 26, the phase of shape of the restriction portion 36 in the state of being held by the frame 27L and the phase of shape of the restriction portion 36 in the state of being held by the frame 27R are equal to each other. More specifically, in the configuration of the first exemplary embodiment, with regard to the bearing 31 mounted to the frame 27L, the position restriction portion 36*b* is situated on the inside of the frame 27L, and, with regard to the bearing 31 mounted to the frame 27R, the position restriction portion 36*b* is situated on the outside of the frame 27R.

According to the configuration of the first exemplary embodiment, as illustrated in FIG. 9A, the inner circumferential surface 34 of the bearing 31 supporting the shaft end portion on one end side of the driving roller 30 deviates in the lower right direction. Then, as illustrated in FIG. 9B, the inner circumferential surface 34 of the bearing 31 supporting the shaft end portion on the other end side of the driving roller 30 also deviates in the lower right direction. In this case, a state in which both end sides of the driving roller 30 deviate in the same direction by the same amount with respect to the frame 27L and the frame 27R, in other words, a state in which the driving roller 30 is horizontally supported, is brought about. As a result, this configuration enables preventing or reducing a lateral-shift force, by which the intermediate transfer belt 26 draws to one side, from becoming large.

As described above, the first exemplary embodiment has a configuration for pivotally supporting the driving roller 30 in such a manner that, as viewed from a direction perpendicular to the width direction of the intermediate transfer belt 26, the phases of position of the respective restriction portions 36 on both end sides of the driving roller 30 are equal to each other. This brings about a state in which both end sides of the driving roller 30 deviate in the same direction by the same amount with respect to the frame 27L and the frame 27R, thus enabling preventing or reducing a lateral-shift force, by which the intermediate transfer belt 26 draws to one side, from becoming large.

Additionally, in the first exemplary embodiment, with regard to the width direction of the intermediate transfer belt 26, a width in which the bearing 31 mounted to the holding hole L1 is in contact with the shaft portion of the driving roller 30 and a width in which the bearing 31 mounted to the holding hole R1 is in contact with the shaft portion of the driving roller 30 are set to the same length. This enables, during rotation of the driving roller 30, making the amounts of abrasion of the respective inner circumferential surfaces 34 caused by sliding movement between the shaft portion of the driving roller 30 and the respective bearings 31 almost equal to each other at both end sides. As a result, it is possible to prevent or reduce the occurrence of inclination of the driving roller 30 due to the abrasion of bearings associated with long-term use of the driving roller 30, and it is thus possible to prevent or reduce a lateral-shift force, by which the intermediate transfer belt 26 draws to one side, from becoming large.

In the first exemplary embodiment, the frame 27L and the frame 27R are configured as an integrated frame. In this way, employing a configuration for holding bearings at both ends with an integrated frame enables attaining a reduction in the number of required parts and a reduction in the amount of deviation of dimensions in supporting various rollers. However, while, in the first exemplary embodiment, a configuration in which an integrated frame is used to support various rollers is employed, the first exemplary embodiment is not limited to this, and, naturally, even if the frame 27L and the frame 27R are configured as separate members, an advantageous effect of the first exemplary embodiment can also be attained.

Moreover, while, in the first exemplary embodiment, a pivotally supporting configuration for the driving roller 30 has been described, the first exemplary embodiment is not limited to this, and, if the configuration of the first exemplary embodiment is used as a configuration for pivotally supporting the driven roller 28 with the bearings 29 at the frame 27R and the frame 27L, an advantageous effect similar to that of the first exemplary embodiment can be attained. Additionally, it is more desirable that the configuration of the first exemplary embodiment is employed for the respective pivotally supporting configurations for the driving roller 30 and the driven roller 28. According to such a configuration, since it is possible to prevent or reduce both the driving roller 30 and the driven roller 28 from being mounted in an inclined manner, it becomes possible to more prevent or reduce a lateral-shift force, by which the intermediate transfer belt 26 draws to one side, from becoming large.

Modification Example

Figure 10A:
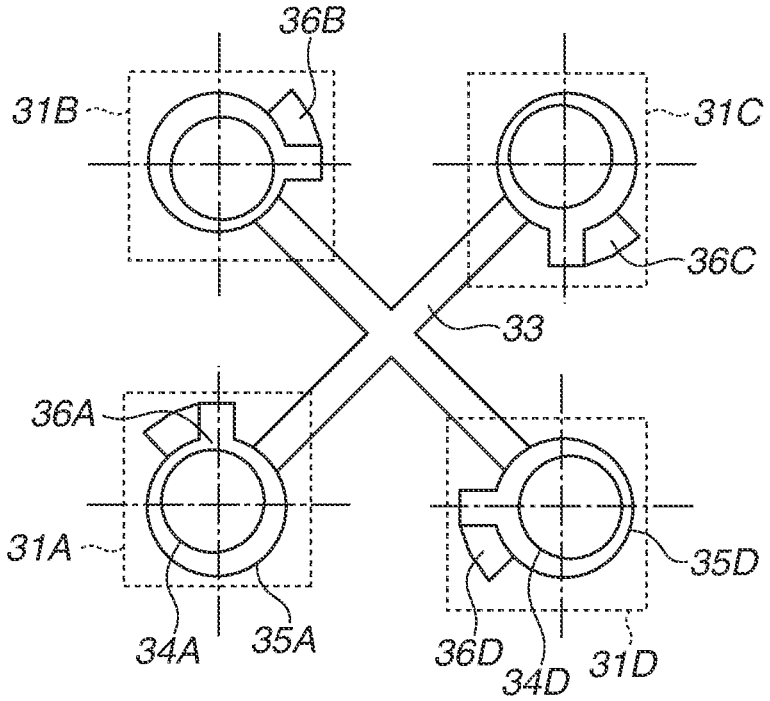
FIGS. 10A and 10B are schematic diagrams used to explain manufacturing and a configuration of a bearing in a modification example of the first exemplary embodiment.
Figure 10B:
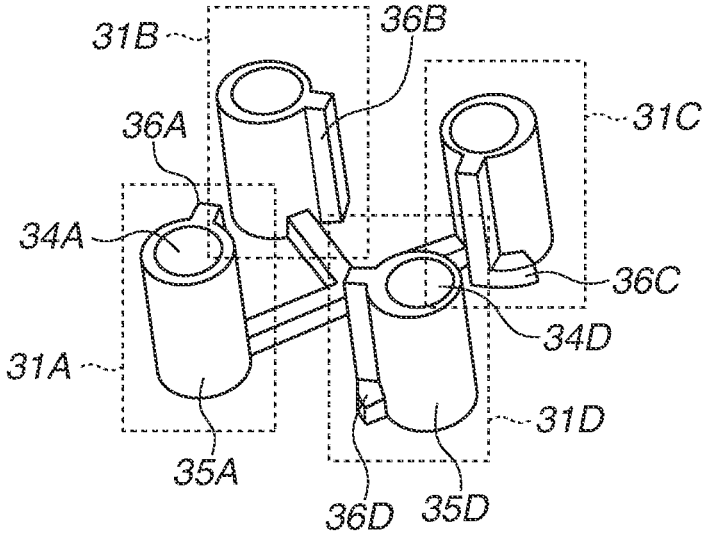

Next, a modification example of the method for manufacturing the bearing 31 in the first exemplary embodiment is described with reference to FIGS. 10A and 10B. FIG. 10A is a schematic top view illustrating a state in which bearings 31A, 31B, 31C, and 31D and a runner 33, which have been obtained by injection molding, are continuous with each other. FIG. 10B is a schematic perspective view illustrating the state in which the bearings 31A, 31B, 31C, and 31D and the runner 33, which have been obtained by injection molding, are continuous with each other. Furthermore, in the following description, constituent elements which are in common between the first exemplary embodiment and the modification example thereof are assigned the respective same reference numerals and the description thereof is not repeated.

The bearings 31A to 31D of the driving roller 30 in the present modification example are manufactured by injection molding, which injects a pellet of polyacetal resin into a mold, so that, to increase a manufacturing efficiency, a plurality of molded components are simultaneously manufactured in one operation of injection molding. For example, as illustrated in FIGS. 10A and 10B, injection molding is able to be performed with one mold in such a manner that four bearings, i.e., bearings 31A, 31B, 31C, and 31D, and a runner 33 which is continuous with the four bearings are concurrently obtained. In this case, cutting off the runner 33 after injection molding enables obtaining the individual bearings 31A, 31B, 31C, and 31D.

With regard to the four bearings 31A to 31D obtained in the above-described way, as illustrated in FIG. 10A, depending on the processing accuracy of a mold, the amount of eccentricity of the center of the inner circumferential surface 34 relative to the center of the outer circumferential surface 35 may become different between bearings. Furthermore, in FIG. 10A, for ease of understanding the state of being eccentric, the amount of eccentricity is exaggeratingly illustrated. Such a difference in the amount of eccentricity between the bearings may cause an inclination of the roller when the bearing is mounted as a bearing for the driving roller 30 or the driven roller 28 at both ends thereof and, thus, may cause a lateral-shift force of the intermediate transfer belt 26 to occur.

Accordingly, in a case where, as in the present modification example, a plurality of bearings 31A to 31D is manufactured in one operation of injection molding, in consideration of a difference in the amount of eccentricity between the bearings, with regard to both end sides of the shaft portion of the driving roller 30, it is more favorable to use bearings which are obtained from the same mold and the amounts of electricity of which are almost equal to each other. Specifically, in the case of mounting the bearing 31A to the left-hand frame 27L, it is favorable to also use the bearing 31A with respect to the right-hand frame 27R. This enables improving the manufacturing efficiency of components and also attaining an advantageous effect similar to that of the first exemplary embodiment.

However, the present modification example is not limited to this, and, for example, a configuration in which the amounts of relative deviation in dimension of the bearings 31A, 31B, 31C, and 31D, which are manufactured by one operation of injection molding, are brought close to zero and the both end sides of the driving roller 30 are respectively pivotally supported by the bearing 31A and the bearing 31C can be employed. Employing such a configuration enables attaining an advantageous effect similar to that of a configuration in which the both end sides of the driving roller 30 are pivotally supported by the same bearings 31A.

Figure 11:
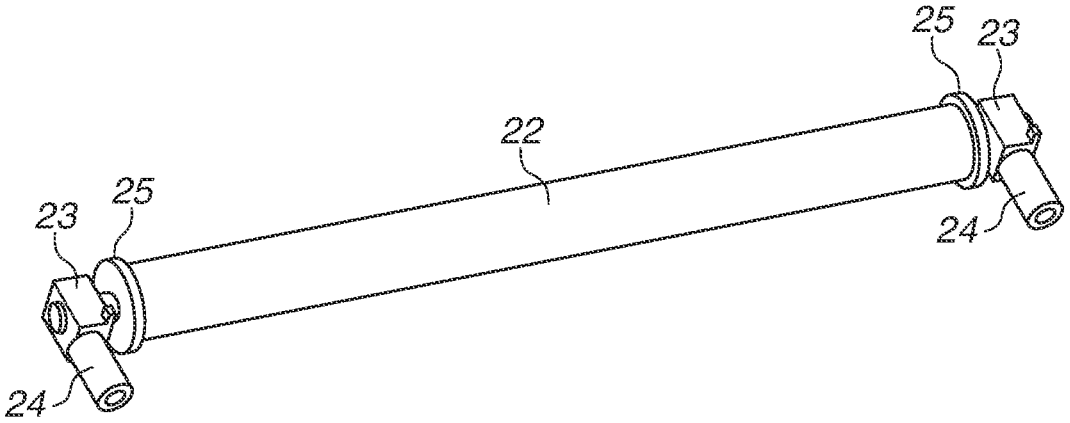
FIG. 11 is a schematic diagram illustrating a configuration of a second exemplary embodiment.

FIG. 11 is a schematic perspective view illustrating a neighborhood configuration of the tension roller 22 with the frame 27L, the frame 27R, and intermediate transfer belt 26 omitted from illustration. In the following description, a second exemplary embodiment is described with reference to FIG. 11. Furthermore, in the following description, constituent elements which are in common with those of the first exemplary embodiment are assigned the respective same reference characters as those in the first exemplary embodiment and the description thereof is not repeated.

In the second exemplary embodiment, a configuration in which both end sides of the tension roller 22 are supported by the bearings 23, which are provided in a slidable manner with respect to the elongated holding holes provided in the frame 27L and the frame 27R, is described. Furthermore, the bearing 23 is manufactured by filling a mold with metallic powder to perform compression molding of the metallic powder and then applying heat to the metallic powder to perform sintering.

As illustrated in FIG. 11, with regard to the bearing 23 in the second exemplary embodiment, as viewed from a direction perpendicular to the width direction of the intermediate transfer belt 26, the phase of shape of the bearing 23 in the state of being held by the frame 27L and the phase of shape of the bearing 23 in the state of being held by the frame 27R are also equal to each other. In this way, the configuration of the first exemplary embodiment can be used for not only the bearings 31 in the first exemplary embodiment, which are fixedly mounted to the frame 27L and the frame 27R, but also the bearings 23, which are movable (slidable) in the holding holes provided in the frame 27L and the frame 27R. Employing such a configuration results in a configuration in which the respective centers on both end sides of the tension roller 22 deviate in the same direction by the same amount with respect to the frame 27L and the frame 27R. This causes the tension roller 22 to be mounted horizontally to the frame 27L and the frame 27R and thus enables preventing or reducing a lateral-shift force of the intermediate transfer belt 26 caused by inclination of the bearings 23 from becoming large.

Modification Example

Figure 12:
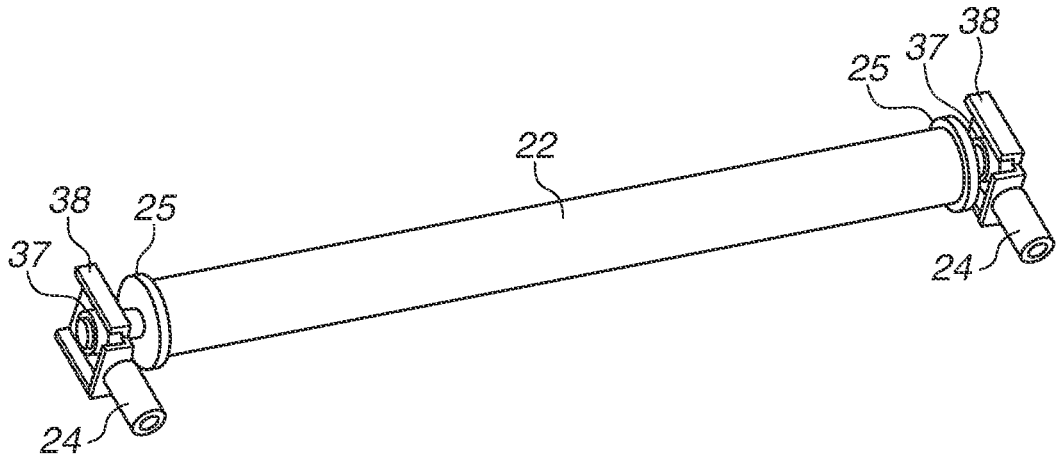
FIG. 12 is a schematic diagram illustrating a configuration of a modification example of the second exemplary embodiment.

FIG. 12 is a schematic diagram illustrating a configuration as a modification example of the second exemplary embodiment and is, specifically, a schematic perspective view illustrating a neighborhood configuration of the tension roller 22 with the frame 27L, the frame 27R, and intermediate transfer belt 26 omitted from illustration. In the present modification example, with regard to the width direction of the intermediate transfer belt 26, the configuration of bearings 38, which support both end portions of the tension roller 22, is different from the configuration of the bearings 23 in the second exemplary embodiment. Furthermore, in the following description, constituent elements which are in common with those of the second exemplary embodiment are assigned the respective same reference characters as those in the second exemplary embodiment and the description thereof is not repeated.

As illustrated in FIG. 12, the bearing 38 includes a frame body portion, which is formed by bending a steel sheet with a press mold and then boring a hole in the bent steel sheet, and a ball bearing 37. Moreover, as illustrated in FIG. 12, with regard to the bearing 38 in the present modification example, as viewed from a direction perpendicular to the width direction of the intermediate transfer belt 26, the phase of shape of the bearing 38 in the state of being held by the frame 27L and the phase of shape of the bearing 38 in the state of being held by the frame 27R are also equal to each other. This makes up a configuration in which, as with the second exemplary embodiment, the respective centers on both end sides of the tension roller 22 deviate in the same direction by the same amount with respect to the frame 27L and the frame 27R, and thus enables preventing or reducing a lateral-shift force of the intermediate transfer belt 26 from becoming large.

Additionally, unlike the configuration of the second exemplary embodiment, in which the tension roller 22 is directly supported by the bearings 23, in the present modification example, the ball bearing 37, which is highly accurate and has no deviation between the center of the inner circumference thereof and the center of the outer circumference thereof, is used to support both end portions of the tension roller 22. This enables, while reducing a rotational load on the tension roller 22, preventing or reducing a positional deviation thereof.

While, in the above-described first and second exemplary embodiments and modification examples thereof, the image forming apparatus 1 of the intermediate transfer type using the transfer unit 8 including the intermediate transfer belt 26 has been described, those exemplary embodiments and modification examples are not limited to this. Employing configurations of those exemplary embodiments and modification examples for an image forming apparatus of the direct transfer method using a transfer unit including a conveyance belt which conveys the transfer material P enables attaining an advantageous effect similar to those of the above-described first and second exemplary embodiments and modification examples thereof.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Applications No. 2019-158449 filed Aug. 30, 2019 and No. 2020-104701 filed Jun. 17, 2020, which are hereby incorporated by reference herein in their entirety.

What is claimed is:

1. A belt conveyance device comprising:

a belt of an endless shape configured to rotationally move;

a first stretching roller and a second stretching roller configured to suspend the belt;

a first bearing member configured to support one shaft end portion of the first stretching roller in a width direction perpendicular to a movement direction of the belt;

a second bearing member configured to support the other shaft end portion of the first stretching roller in the width direction, the first bearing member and the second bearing member being members formed by injection molding with a mold;

a first frame portion including a first holding portion for holding the first bearing member;

a second frame portion including a second holding portion for holding the second bearing member, wherein the first bearing member includes a first projection portion and another first projection portion which project from an outer circumferential surface of the first bearing member, the first projection portion configured to restrict a rotation of the first bearing member relative to the first frame portion, and the another first projection portion, being disposed on an upstream side of the first projection portion in a first orientation which is a direction from the second frame side to the first frame side in the width direction, and configured to restrict a movement of the first bearing member in the first orientation, wherein the second bearing member includes a second projection portion and another second projection portion which project from an outer circumferential surface of the second bearing member, the second projection portion configured to restrict a rotation of the second bearing member relative to the second frame portion, and the another second projection portion, being disposed on an upstream side of the second projection portion in the first orientation, and configured to restrict a movement of the second bearing member in the first orientation.

2. The belt conveyance device according to claim 1, wherein the shaft end portions of the first stretching roller are able to rotate while frictionally sliding on the first bearing member and the second bearing member in a state of being supported by the first bearing member and the second bearing member.

3. The belt conveyance device according to claim 1, wherein the first bearing member and the second bearing member have an identical shape.

4. The belt conveyance device according to claim 3, wherein the first bearing member and the second bearing member are members formed by using an identical mold.

5. The belt conveyance device according to claim 1, wherein the second stretching roller includes one restriction member which is located on a side of the first frame portion in the width direction and which is able to come into contact with an end portion of the belt on the side of the first frame portion and another restriction member which is located on a side of the second frame portion in the width direction and which is able to come into contact with an end portion of the belt on the side of the second frame portion.

6. The belt conveyance device according to claim 1, wherein the first stretching roller is a driving roller which, upon receiving a driving force, rotates to rotationally move the belt.

7. The belt conveyance device according to claim 1, further comprising:

a third stretching roller different from the first stretching roller and the second stretching roller;

a third bearing member configured to support one shaft end portion of the third stretching roller in the width direction; and a fourth bearing member configured to support the other shaft end portion of the third stretching roller in the width direction, wherein the third stretching roller is supported by the first frame portion and the second frame portion and is driven to rotate in conjunction with the belt rotationally moving, wherein the third bearing member includes a third restriction portion for restricting a rotation of the third bearing member relative to the first frame portion and the fourth bearing member includes a fourth restriction portion for restricting a rotation of the fourth bearing member relative to the second frame portion, and wherein a phase of arrangement of the third restriction portion in a state of being held by the first frame portion and a phase of arrangement of the fourth restriction portion in a state of being held by the second frame portion are equal to each other.

8. An image forming apparatus comprising:

a plurality of image bearing members configured to respectively bear toner images of different colors;

a belt of an endless shape configured to rotationally move;

a first stretching roller and a second stretching roller configured to suspend the belt;

a first bearing member configured to support one shaft end portion of the stretching roller in a width direction perpendicular to a movement direction of the belt;

a second bearing member configured to support the other shaft end portion of the stretching roller in the width direction, the first bearing member and the second bearing member being members formed by injection molding with a mold;

a first frame portion including a first holding portion for holding the first bearing member; and a second frame portion including a second holding portion for holding the second bearing member, wherein the first bearing member includes a first projection portion and another first projection portion which project from an outer circumferential surface of the first bearing member, the first projection portion configured to restrict a rotation of the first bearing member relative to the first frame portion, and the another first projection portion, being disposed on an upstream side of the first projection portion in a first orientation which is a direction from the second frame side to the first frame side in the width direction, and configured to restrict a movement of the first bearing member in the first orientation, wherein the second bearing member includes a second projection portion and another second projection portion which project from an outer circumferential surface of the second bearing member, the second projection portion configured to restrict a rotation of the second bearing member relative to the second frame portion, and the another second projection portion, being disposed on an upstream side of the second projection portion in the first orientation, and configured to restrict a movement of the second bearing member in the first orientation.

9. The image forming apparatus according to claim 8, wherein the belt is an intermediate transfer belt, and wherein the toner images borne on the plurality of image bearing members are primarily transferred from the plurality of image bearing members to the intermediate transfer belt and the toner images transferred to the intermediate transfer belt are then secondarily transferred from the intermediate transfer belt to a transfer material.

10. The image forming apparatus according to claim 8, wherein the belt is a conveyance belt configured to bear and convey a transfer material, and wherein the toner images borne on the plurality of image bearing members are transferred to the transfer material conveyed by the conveyance belt.

* * * * *